US012352512B2

(12) United States Patent
Shin et al.

(10) Patent No.: US 12,352,512 B2
(45) Date of Patent: Jul. 8, 2025

(54) PLATE-TYPE HEAT EXCHANGER HAVING BRACKET-REINFORCING STRUCTURE

(71) Applicant: Hanon Systems, Daejeon (KR)

(72) Inventors: Sung Hong Shin, Daejeon (KR); Wontaek Lee, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 138 days.

(21) Appl. No.: 18/270,529

(22) PCT Filed: Jan. 12, 2022

(86) PCT No.: PCT/KR2022/000590
§ 371 (c)(1),
(2) Date: Jun. 30, 2023

(87) PCT Pub. No.: WO2022/154495
PCT Pub. Date: Jul. 21, 2022

(65) Prior Publication Data

US 2024/0011725 A1 Jan. 11, 2024

(30) Foreign Application Priority Data

Jan. 13, 2021 (KR) ..... 10-2021-0004545
Jan. 10, 2022 (KR) ..... 10-2022-0003200

(51) Int. Cl.
*F28F 9/00* (2006.01)
*F28D 9/00* (2006.01)
*F28F 9/007* (2006.01)

(52) U.S. Cl.
CPC ..... *F28F 9/0075* (2013.01); *F28D 9/005* (2013.01)

(58) Field of Classification Search
CPC ..... F28D 9/005; F28F 9/0075; F28F 2280/06; F28F 2225/00
See application file for complete search history.

(56) References Cited

U.S. PATENT DOCUMENTS 5,927,394 A 7/1999 Mendler et al.

FOREIGN PATENT DOCUMENTS

| | | | | |
|---|---|---|---|---|
| EP | 2138793 | A2 * | 12/2009 | ..... F28D 9/005 |
| JP | H051890 | A | 1/1993 | |
| JP | 2000310497 | A | 11/2000 | |
| JP | 2014521921 | A | 8/2014 | |
| KR | 101545648 | B1 | 8/2015 | |
| KR | 20200067494 | A | 6/2020 | |
| WO | WO-2014048219 | A1 * | 4/2014 | ..... B23P 15/26 |

OTHER PUBLICATIONS

International Search Report issued in PCT/KR2022/000590 on Apr. 22, 2022.

* cited by examiner

*Primary Examiner* — Eric S Ruppert
(74) *Attorney, Agent, or Firm* — NORTON ROSE FULBRIGHT US LLP

(57) ABSTRACT

The present invention relates to a plate-type heat exchanger having a bracket-reinforcing structure. An object of the present invention is to provide a plate-type heat exchanger having a bracket-reinforcing structure that has a reinforcing plate attached to prevent exposure of the plate-type heat exchanger in a region in which a bracket plate of an assembly of the plate-type heat exchanger and the bracket plate is connected to an external device, thereby suppressing the corrosion of the plate-type heat exchanger and improving the durability of the plate-type heat exchanger.

16 Claims, 4 Drawing Sheets

Prior Art

PLATE-TYPE HEAT EXCHANGER HAVING BRACKET-REINFORCING STRUCTURE

CROSS REFERENCE TO RELATED APPLICATIONS

This patent application is a national phase under 35 U.S.C. § 371 of International Patent Application No. PCT/KR2022/000590 filed Jan. 12, 2022, which claims the benefit of priority from Korean Patent Application Nos. 10-2021-0004545 filed Jan. 13, 2021, and 10-2022-0003200 filed Jan. 10, 2022, each of which is hereby incorporated herein by reference in its entirety for all purposes.

TECHNICAL FIELD

The present invention relates to a plate-type heat exchanger having a bracket-reinforcing structure, and more particularly, to a plate-type heat exchanger having a bracket-reinforcing structure, which is capable of minimizing a problem with corrosion and durability of an assembly of the plate-type heat exchanger and a bracket plate.

BACKGROUND ART

In general, not only components such as an engine for operating a vehicle are provided in an engine room of the vehicle, but also various heat exchangers such as a radiator, an intercooler, an evaporator, and a condenser for cooling the components such as the engine in the vehicle or adjusting an air temperature in an interior of the vehicle are provided in the engine room of the vehicle. In general, heat exchange media flow in the heat exchangers. The heat exchange medium in the heat exchanger exchanges heat with outside air present outside the heat exchanger, such that the cooling operation or the heat dissipation is performed. A heat exchanger, which allows a single type of heat exchange medium to exchange heat with outside air, is also referred to as an air-cooled heat exchanger.

In most cases, a single type of heat exchange medium flows in the heat exchanger. However, as necessary, heat exchangers, in which two types of heat exchange media flow, are sometimes integrated. In case that two types of heat exchange media flow, the two types of heat exchange media may perform a cooling operation by exchanging heat with outside air. Even this case corresponds to the air-cooled heat exchanger. However, a configuration in which one of two types of heat exchange media is a coolant in a case in which the two types of heat exchange media exchange heat with each other, is also referred to as a coolant-cooled heat exchanger. Various embodiments of heat exchangers are present. A heat exchanger, in which the two types of heat exchange media exchange heat with each other, may be configured such that a structure such as a pipe, through which one single type of heat exchange medium flows, is simply inserted into a space in which the other single type of heat exchange medium flows. Alternatively, a plate-type heat exchanger may be configured such that different types of heat exchange media flow to respective layers, and the heat exchange is performed at boundaries between the layers. One of the embodiments of coolant-cooled plate-type heat exchangers, which are used generally and widely, is well disclosed in Korean Patent No. 1545648 (entitled "plate-type heat exchanger" (Aug. 12, 2015), hereinafter, referred to as a 'patent document'). As disclosed in the patent document, a heat exchanger core of the plate-type heat exchanger has a shape, such as a quadrangular dish shape, made by stacking a plurality of main plates each having a shape having four sides bent upward.

FIG. 1 is a perspective view of the plate-type heat exchanger disclosed in the patent document. As illustrated, a heat exchanger core 10 includes a stack of a plurality of main plates 15. The main plate 15 includes a center flat plate 11 having a fluid-flowing structure including a through hole formed in the center flat plate, and a lateral blade 12 formed by bending an edge of the center flat plate 11 in one direction. The heat exchanger core 10 has structures, such as a fixing structure or a receiver dryer, configured to connect the heat exchanger core 10 to another external device.

One of the structures is a bracket plate. A part of the bracket plate, which is almost the entire part of the bracket plate, is coupled to be in surface contact with one surface of the heat exchanger core 10, the remaining part is bent in another direction and coupled to the external device. Therefore, the heat exchanger core 10 and the external device are connected by the bracket plate.

In this case, a part of the main plate 15 of the heat exchanger core 10 is necessarily exposed in a portion of the bracket plate that is bent to connect the bracket plate to the external device. In addition, because the above-mentioned portion of the bracket plate is an outermost side, a part of the exposed portion is configured by a single layer. The corrosion performance deteriorates because the heat exchanger core 10 is exposed as described above. Further, because a coupled portion of the heat exchanger core 10 is configured as a single layer, the durability deteriorates. As a result, there is a problem in that a risk of leakage of the heat exchange medium increases as the corrosion in the corresponding portion accelerates.

DOCUMENT OF RELATED ART

Patent Document

Korean Patent No. 1545648 ("Plate-Type Heat Exchanger", Aug. 12, 2015)

DISCLOSURE

Technical Problem

The present invention has been made in an effort to solve the above-mentioned problem in the related art, and an object of the present invention is to provide a plate-type heat exchanger having a bracket-reinforcing structure that has a reinforcing plate attached to prevent exposure of the plate-type heat exchanger in a region in which a bracket plate of an assembly of the plate-type heat exchanger and the bracket plate is connected to an external device, thereby suppressing the corrosion of the plate-type heat exchanger and improving the durability of the plate-type heat exchanger.

Technical Solution

To achieve the above-mentioned object, the present invention provides a plate-type heat exchanger including: a plurality of stacked main plates 15 each including a center flat plate 11 having a fluid flowing structure including a through hole formed in the center flat plate, and a lateral blade 12 formed by bending an edge of the center flat plate 11 in one direction; and a reinforcing plate 20 interposed between a bracket plate 100 fixed to an external device and the main plate 15 connected to the bracket plate 100.

In this case, the reinforcing plate 20 and the bracket plate 100 may be at least partially in surface contact with each other.

In addition, the reinforcing plate 20 and the main plate 15 may be at least partially in surface contact with each other.

In addition, in the plate-type heat exchanger, a flow path, through which a fluid flows, may be formed between the main plates 15, and a distance d1 from an outermost peripheral flow path closest to the bracket plate 100 to the bracket plate 100 may be larger than a thickness t1 of the main plate 15. More particularly, in the plate-type heat exchanger, the distance d1 from the outermost peripheral flow path to the bracket plate 100 may be equal to or larger than 2 times the thickness t1 of the main plate 15.

In addition, in the plate-type heat exchanger, a thickness t2 of the reinforcing plate 20 and the thickness t1 of the main plate 15 may be different from each other. More particularly, in the plate-type heat exchanger, the thickness t2 of the reinforcing plate 20 may be larger than the thickness t1 of the main plate 15.

In addition, in the plate-type heat exchanger, the reinforcing plate 20 may be formed separately from the main plate 15.

Alternatively, in the plate-type heat exchanger, the reinforcing plate 20 is integrated with the main plate 15. In this case, in the plate-type heat exchanger, the reinforcing plate 20 may be formed by increasing a thickness of the main plate 15.

In a specific embodiment, the reinforcing plate 20 may be in surface contact with the entire center flat plate 11 of the main plate 15 and be in surface contact with at least a part of the lateral blade 12.

In addition, when some of the lateral blades 12 of the main plates 15 overlap one another to define a multilayer and the remaining lateral blades 12 of some of the main plates 15, which do not overlap one another, define a single layer as a heat exchanger core 10 is formed by stacking the plurality of main plates 15 so that the plurality of main plates 15 overlaps one another, the reinforcing plate 20 may be in surface contact with the lateral blade 12 in a region including a single-layer forming region of the lateral blade 12 in which the single layer is formed.

In addition, the bracket plate 100 may include: a fixing plate portion 110 including a plate surface portion 111 provided to be in surface contact with one surface of the heat exchanger core 10, and a peripheral portion 112 bent from an edge of the plate surface portion 111 and configured to surround a part of a periphery of the heat exchanger core 10; and a connection plate portion 120 integrated with the fixing plate portion 110 and bent in a direction different from that of the peripheral portion 112 in a region except for a region in which the peripheral portion 112 is formed, the connection plate portion 120 being connected to the external device, and the reinforcing plate 20 may be in surface contact with at least a part of the lateral blade 12 in a region in which the connection plate portion 120 is formed.

In addition, the reinforcing plate 20 may be formed in a shape of the main plate 15 excluding the fluid flowing structure.

In addition, the reinforcing plate 20 may be formed to have a thickness corresponding to the main plate 15.

In addition, the reinforcing plate 20 may be made of the same type of metallic material as the main plate 15.

In addition, in the plate-type heat exchanger, corrosion potential of the main plate 15 may be equal to or higher than corrosion potential of the reinforcing plate 20.

In this case, in the plate-type heat exchanger, the corrosion potential of the reinforcing plate 20 may be equal to or higher than corrosion potential of the bracket plate 100.

In addition, in the plate-type heat exchanger, all the main plate 15, the reinforcing plate 20, and the bracket plate 100 may be made of the same type of metallic material.

In addition, in the plate-type heat exchanger, all the main plate 15, the reinforcing plate 20, and the bracket plate 100 may be joined by brazing.

Advantageous Effects

According to the present invention, the reinforcing plate is attached to the surface to which the bracket plate of the plate-type heat exchanger is coupled. Therefore, it is possible to prevent the plate-type heat exchanger from being exposed in the region in which the bracket plate is connected to the external device. Of course, it is possible to basically suppress the problem of corrosion accelerated by exposure and consequently improve the corrosion performance. In particular, in the present invention, the corrosion potential difference between the main plate, the reinforcing plate, and the bracket plate of the plate-type heat exchanger is appropriately set, thereby further improving the corrosion performance of the main plate. Furthermore, according to the present invention, the reinforcing plate is attached to the plate-type heat exchanger, thereby improving the durability.

DESCRIPTION OF REFERENCE NUMERALS

Figure 1:
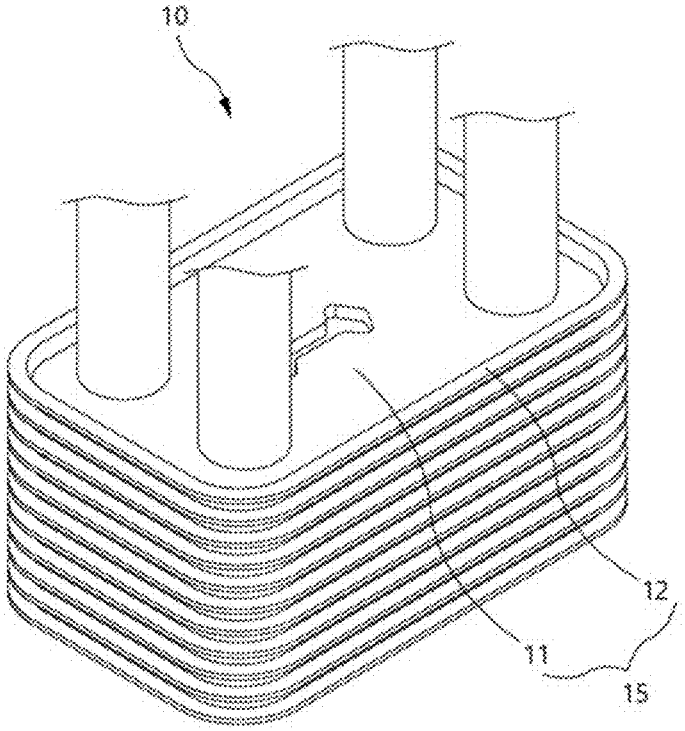
FIG. 1 is a perspective view of a plate-type heat exchanger in the related art.

10: Plate-type heat exchanger
15: Main plate
11: Center flat plate
12: Lateral blade
20: Reinforcing plate
100: Bracket plate
110: Fixing plate portion
120: Connection plate portion
111: Plate surface portion
112: Peripheral portion
200: Receiver dryer
250: Connector

MODE FOR INVENTION

Hereinafter, a plate-type heat exchanger having a bracket-reinforcing structure according to the present invention configured as described above will be described in detail with reference to the accompanying drawings.

Figure 2:
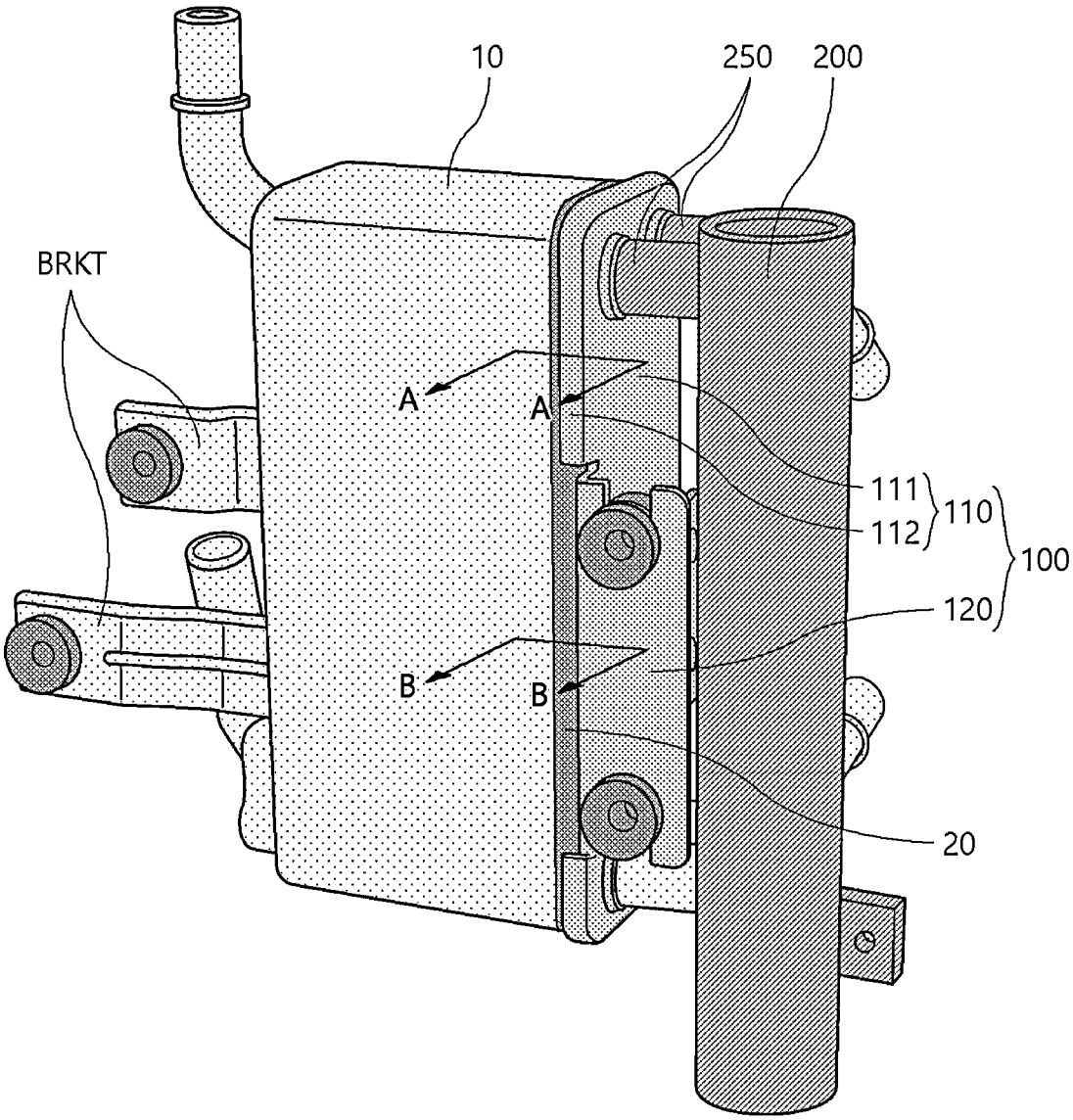
FIG. 2 is a perspective view of an assembly of a plate-type heat exchanger and a bracket plate of the present invention.
Figure 3:
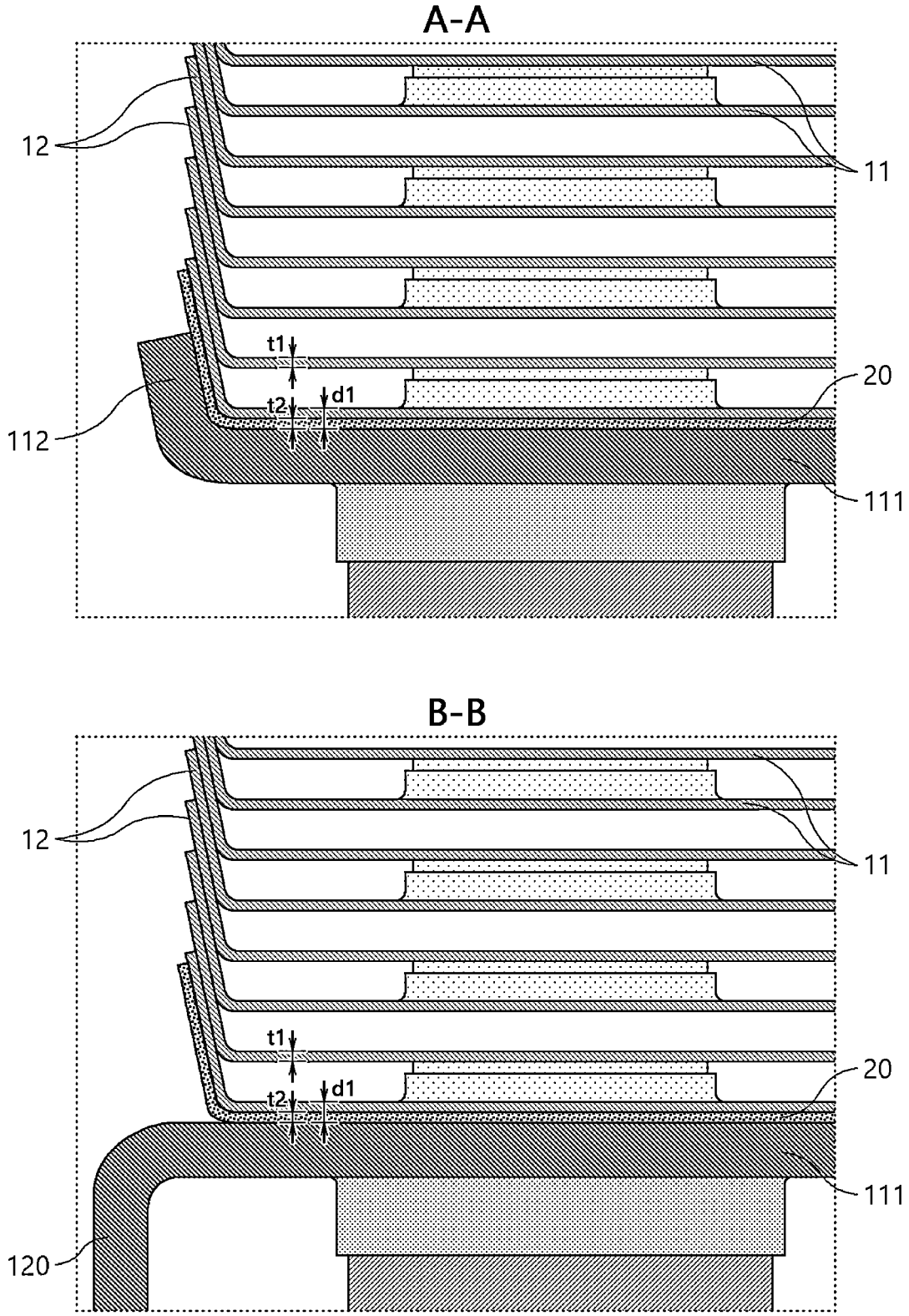
FIG. 3 is a partial cross-sectional view of the assembly of the plate-type heat exchanger and the bracket plate of the present invention.

FIG. 2 is a perspective view of an assembly of a plate-type heat exchanger and a bracket plate of the present invention, and FIG. 3 is a partial cross-sectional view of the assembly of the plate-type heat exchanger and the bracket plate of the present invention.

Similar to a heat exchanger core of a general plate-type heat exchanger, a heat exchanger core 10 of a plate-type heat exchanger of the present invention is basically formed by stacking a plurality of main plates 15. The main plate 15 includes a center flat plate 11 having a fluid-flowing structure including a through hole formed in the center flat plate, and a lateral blade 12 formed by bending an edge of the center flat plate 11 in one direction. In this case, the fluid-flowing structure provided on the center flat plate 11 includes a through hole configured to allow a particular fluid to move to another layer, a peripheral wall formed around the through hole and configured to prevent the particular fluid from entering one layer, a partition wall configured to guide a flow direction of the fluid, and a bead configured to generate a turbulent flow in the flow. In addition, the configuration in which the fluid flowing structure is formed means that a flow path, through which a fluid flows, is naturally formed between the main plates 15. Meanwhile, to smoothly stack the plurality of main plates 15, the lateral blade 12 is bent while having a slight inclination angle in a shape that is spread outward without being bent perpendicularly to the center flat plate 11. The center flat plate 11 generally has an approximately rectangular shape. The lateral blade 12 is formed by bending an edge of the rectangular plate upward at a slight inclination angle, such that the main plate 15 is formed in an approximately quadrangular dish shape. With this shape, the center flat plates 11 of the main plates 15 are spaced apart from one another to some extent without being in contact with one another when the plurality of main plates 15 is stacked, and the separation space defines "the flow path through which the fluid flows between the main plates".

As described above, the plate-type heat exchanger is fixed to an external device by a bracket plate 100 connected to one surface of the heat exchanger core 10 while being in surface contact with one surface of the heat exchanger core 10. In this case, the plate-type heat exchanger includes a reinforcing plate 20 interposed between the bracket plate 100 and the main plate 15 of the bracket plate 100 and disposed to be in surface contact with the main plates 15. In this case, all the main plate 15, the reinforcing plate 20, and the bracket plate 100 may be joined by brazing.

As described above, the reinforcing plate 20 is basically interposed between the bracket plate 100 and the main plate 15, and the reinforcing plate 20 is at least partially in surface contact with the bracket plate 100 and the main plate 15. That is, the reinforcing plate 20 may be at least partially in surface contact with the bracket plate 100. In addition, the reinforcing plate 20 may be at least partially in surface contact with the main plate 15.

In a specific embodiment, as illustrated in FIG. 3, the reinforcing plate 20 is disposed to be in surface contact with the entire center flat plate 11 of the main plate 15 and disposed to be in surface contact with at least a part of the lateral blade 12. More specifically, when some of the lateral blades 12 of the main plates 15 overlap one another to define a multilayer and the remaining lateral blades 12 of some of the main plates 15, which do not overlap one another, define a single layer as the heat exchanger core 10 is formed by stacking the plurality of main plates 15, the reinforcing plate 20 is in surface contact with the lateral blade 12 in a region including a single-layer forming region of the lateral blade 12 in which the single layer is formed.

The configuration of the bracket plate 100 will be more specifically described below to clearly explain the arrangement position of the reinforcing plate 20. The bracket plate 100 includes a fixing plate portion 110 and a connection plate portion 120. The fixing plate portion 110 is formed in a shape almost corresponding to the main plate 15. That is, the fixing plate portion 110 includes a plate surface portion 111 being in surface contact with one surface of the heat exchanger core 10, and a peripheral portion 112 bent from an edge of the plate surface portion 111 and configured to surround a part of a periphery of the heat exchanger core 10. The connection plate portion 120 is integrated with the fixing plate portion 110. The connection plate portion 120 is bent in a direction different from a direction of the peripheral portion 112 in a region except for a region in which the peripheral portion 112 is formed. Further, the connection plate portion 120 is connected to the external device. That is, based on FIG. 2, a left side of the heat exchanger core 10 is fixed to the external device by brackets BRKT connected directly to the heat exchanger core 10, and a right side of the heat exchanger core 10 is coupled to the fixing plate portion 110 of the bracket plate 100, such that the connection plate portion 120 of the bracket plate 100 is connected and fixed to the external device. In the example in FIG. 2, the external device connected to the bracket plate 100 is a receiver dryer 200. As illustrated, the heat exchanger core 10 is connected to the receiver dryer 200 by connectors 250 so that a refrigerant may flow between the heat exchanger core 10 and the receiver dryer 200. That is, in the example in FIG. 2, the heat exchanger core 10 operates as a coolant-cooled condenser.

In the above-mentioned structure, the top drawing in FIG. 3 shows a cross-section taken along line A-A in FIG. 2, and the bottom drawing in FIG. 3 shows a cross-section taken along line B-B in FIG. 2. As illustrated in FIG. 2, the fixing plate portion 110 includes the plate surface portion 111 being in surface contact with one surface of the heat exchanger core 10, and the peripheral portion 112 bent from the edge of the plate surface portion 111 and configured to surround a part of the periphery of the heat exchanger core 10. In this case, because all the constituent elements of the bracket plate 100 are integrated, the peripheral portion 112 is not formed in the region in which the connection plate portion 120 is formed. That is, the cross-sectional view taken along line A-A is a cross-sectional view of the region in which the peripheral portion 112 is present. The cross-sectional view taken along line B-B is a cross-sectional view of the region in which the connection plate portion 120 is present instead of the peripheral portion 112.

As described above, the heat exchanger core 10 is a stack of the main plates each having a shape such as a quadrangular dish shape. Therefore, the lateral surfaces of the main plates are formed as a multilayer when the main plates are stacked, and some of the lateral blades 12 overlap one another. In this case, as illustrated in the cross-sectional view taken along line A-A, the peripheral portion 112 and the lateral surface of the heat exchanger core 10, which is the portion formed as a multilayer, are coupled by being in contact with each other in the region in which the peripheral portion 112 is present. As described above, the structure made by stacking and coupling the plurality of plates is formed in the region in which the peripheral portion 112 is present, thereby obtaining an additional effect of improving the corrosion performance and durability.

In the related art, the remaining lateral blades 12 of some of the main plates 15 (i.e., the main plates 15 disposed at the outermost side), which do not overlap one another, are formed as a single layer. Further, in a cross-sectional portion taken along line B-B, i.e., the region in which the connection plate portion 120 is formed, the bracket plate 100 cannot surround the heat exchanger core 10, and the heat exchanger core 10 is exposed to the outside without change. In addition, the heat exchanger core 10 has only the single layer in the portion where the bracket plate 100 and the heat exchanger core 10 are coupled. For this reason, there is a problem in which the degradation of corrosion performance and durability of the coupled portion caused by the exposure complexly accelerates corrosion, which increases a risk of leakage of the heat exchange medium.

However, in the present invention, the heat exchanger core 10 is interposed between the bracket plate 100 and the main plate 15 connected to the bracket plate 100 and includes the reinforcing plate 20 disposed to be in surface contact with the main plate 15, thereby solving the above-mentioned problem. More specifically, as illustrated in the cross-section taken along line B-B in the bottom drawing of FIG. 3, the reinforcing plate 20 is formed to be in surface contact with the lateral blade 12 in the region including the single-layer forming region of the lateral blade 12 in which the single layer is formed. More specifically, the reinforcing plate 20 is disposed to be in surface contact with at least a part of the lateral blade 12 in the region in which the connection plate portion 120 is formed.

In the related art, a part of the periphery of the heat exchanger core 10 is exposed to the outside without change in the region in which the connection plate portion 120 is formed. However, in the present invention, the reinforcing plate 20 may be provided, and the reinforcing plate 20 may effectively prevent the exposure of the main plate 15 disposed at an outermost side of one surface of the heat exchanger core 10 in the region in which the connection plate portion 120 is formed. With reference to the cross-section taken along line B-B of FIG. 3, it can be ascertained that because the reinforcing plate 20 is provided, there is no portion where the main plate 15 is exposed and no portion where the heat exchanger core 10 is configured as a single layer in the entire portion where the heat exchanger core 10 and the bracket plate 100 are coupled.

The reinforcing plate 20 will be described below in more detail.

The reinforcing plate 20 may have any shape as long as the reinforcing plate 20 may completely surround one surface of the heat exchanger core 10 as described above. The reinforcing plate 20 may be formed in a shape of the main plate 15 excluding the fluid flowing structure as a shape that may be most easily considered. Meanwhile, in case that the reinforcing plate 20 is too thick, the reinforcing plate 20 may be hardly formed in a desired shape. In case that the reinforcing plate 20 is too thin, it is difficult to obtain a sufficient reinforcement effect. In consideration of these situations, the reinforcing plate 20 may be formed to have a thickness corresponding to the main plate 15, i.e., a thickness similar to a thickness of the main plate 15.

The thickness of the reinforcing plate 20 will be described below in more detail. The configuration has been described above in which the flow path through which the fluid flows is formed between the main plates 15. In this case, it is assumed that a distance from an outermost peripheral flow path closest to the bracket plate 100 to the bracket plate 100 is d1, a thickness of the main plate 15 is t1, and a thickness of the reinforcing plate 20 is t2. In this case, the distance d1 from the outermost peripheral flow path closest to the bracket plate 100 to the bracket plate 100 may be larger than the thickness t1 of the main plate 15. Particularly, the distance d1 from the outermost peripheral flow path to the bracket plate 100 is equal to or larger than 2 times the thickness t1 of the main plate 15.

In the embodiment in FIG. 3, the reinforcing plate 20 is formed separately from the main plate 15. In this case, the distance d1 from the outermost peripheral flow path to the bracket plate 100 eventually becomes a value made by summing up the thickness t1 of the main plate 15 and the thickness t2 of the reinforcing plate 20. From this point of view, the above-mentioned description may mean that the appropriate d1 may be ensured as the thickness t2 of the reinforcing plate 20 is not 0. That is, the above-mentioned description means that the reinforcing plate 20 may be similar to or somewhat thicker than the main plate 10. More specifically, the thickness t2 of the reinforcing plate 20 may be different from the thickness t1 of the main plate 15. The thickness t2 of the reinforcing plate 20 may be larger than the thickness t1 of the main plate 15.

Meanwhile, as described below in more detail, the reinforcing plate 20 may be made of the same type of metallic material as the main plate 15 in consideration of corrosion potential. In this case, although not illustrated in the drawings, in case that the reinforcing plate 20 is made of the same type of metallic material as the main plate 15, the main plate 15 at the outermost periphery may be easily manufactured to be thick in comparison with a case in which the reinforcing plate 20 and the main plate 15 are manufactured as separate components. In other words, the reinforcing plate 20 may be integrated with the main plate 15. In this case, the reinforcing plate 20 is formed by increasing the thickness of the main plate 15.

Hereinafter, the corrosion potential will be described below. The corrosion potential refers to the electric potential related to a combination electrode (saturated calomel electrode, silver chloride electrode, etc.) of metal that is being corroded. When corrosion occurs in an electrolyte, current flows through the metal and polarization occurs due to the formation of a corrosion cell. As the current increases, the potential at the cathode decreases, the potential at the anode increases, and eventually the potentials at the anode become equal. In this case, the potential is referred to as the corrosion potential, and the corrosion potential in the natural state is referred to as the natural corrosion potential. The dimensions of the corrosion potential cannot be measured directly from the potential difference between the metal and the electrolyte solution. Therefore, it is common to use a combination electrode with the constant electrode potential to measure the potential difference between the potential of the metal and the potential of the combination electrode.

In consideration of these situations, it is preferred to consider the corrosion potential in the corresponding part to improve the corrosion performance. The higher the corrosion potential, the less corrosion will occur. It is preferable for the main plate 15 to have the highest corrosion potential, considering that the reason for considering corrosion in the heat exchanger is to prevent fluid leakage. Furthermore, even though the main plate 15 is corroded, fluid leakage can be effectively prevented if the reinforcing plate 20 remains intact. Therefore, the corrosion potential of the reinforcing plate 20 is preferably lower than the corrosion potential of the main plate 15 but higher than the corrosion potential of the bracket plate 100.

In other words, it is preferred that the corrosion potential of the main plate 15 is basically formed to be equal to or higher than the corrosion potential of the reinforcing plate 20. Additionally, the corrosion potential of the reinforcing plate 20 may be formed to be equal to or higher than the corrosion potential of the bracket plate.

In other words, collectively, the relationship between the corrosion potentials of the bracket plate 100, the reinforcing plate 20, and the main plate 15 is most preferably formed as shown in the expression below.

Corrosion potential of bracket plate<Corrosion potential of reinforcing plate<Corrosion potential of main plate Of course, this is an idealized view. In case that a material is used that allows a corrosion potential difference to form between parts, which may cause problems with productivity and manufacturability, such as an increase in manufacturing costs. In addition, there are other factors such as stiffness and moldability that need to be considered in addition to corrosion performance. Therefore, using different materials for different parts only based on corrosion performance may have an adverse effect on overall performance. In addition, in the case of assemblies with assembled multiple components as an alternative to corrosion potential design, in case that only one particular component corrodes, the vulnerable area will be concentrated. In contrast, in case that corrosion is uniformly distributed between the components constituting the assembly, the vulnerable areas may be distributed and the degree of vulnerability of each part may be reduced. In consideration of the above-mentioned situations, the relationship between the corrosion potentials of the bracket plate 100, the reinforcing plate 20, and the main plate 15 is most preferably formed as shown in the equation below. In this case, all the main plate 15, the reinforcing plate 20, and the bracket plate 100 may be made of the same type of metallic material.

Corrosion potential of bracket plate=Corrosion potential of reinforcing plate=Corrosion potential of main plate

| Component | | Thickness (mm) | Material | Corrosion potential (mV) | Corrosion evaluation result (CASS) | Strength (Rm, MPa) |
|---|---|---|---|---|---|---|
| Main plate | | 0.457 | HF342 | −690 | — | 130-160 |
| Bracket plate | Prior art | 1.2 | HF355 | −660 | Corrosion occurs on main plate due to low corrosion potential difference of main plate → Refrigerant leakage | 140-170 |
| | Present invention | | HF342 | −690 | Suppressing corrosion on main plate by adding reinforcing plate and differential corrosion potentials | 130-170 |

Figure 4:
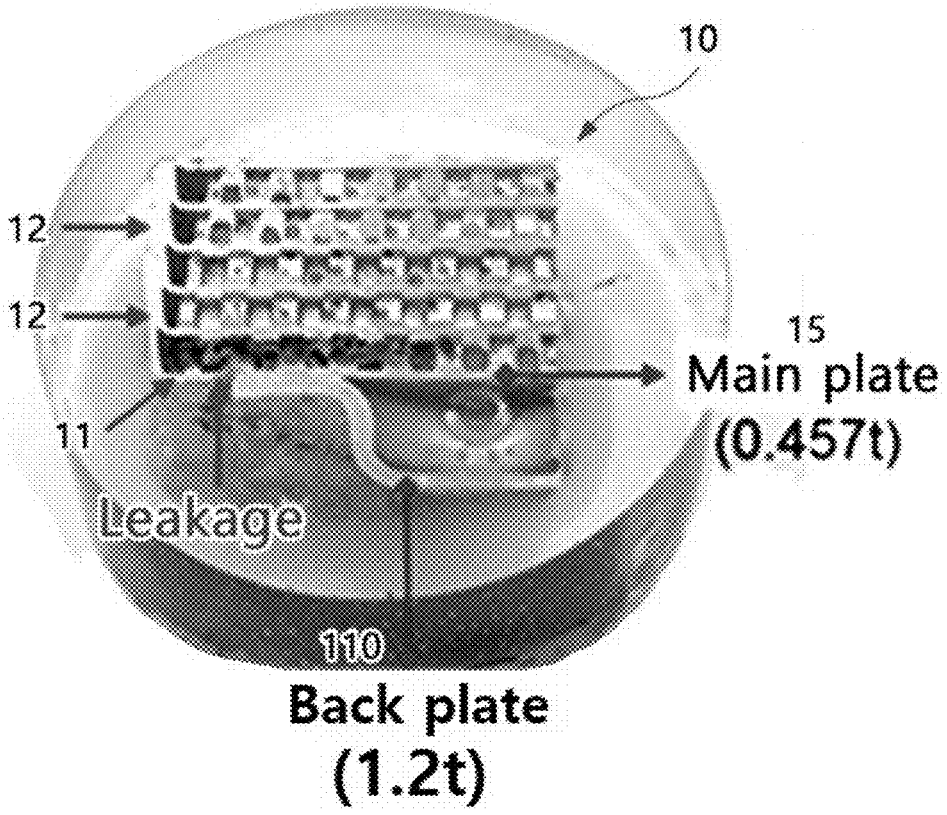
FIG. 4 is a photograph illustrating a corroded state of an actual plate-type heat exchanger.

FIG. 4 is a photograph showing a corroded state of an actual plate-type heat exchanger. FIG. 4 is a photograph of a plate-type heat exchanger in the prior art, i.e., a plate-type heat exchanger having no reinforcing plate of the present invention. As shown in FIG. 4, in the prior art, corrosion does not significantly occur on the lateral blade 12, i.e., the portion where the main plate 15 is configured as a multilayer. However, because no reinforcing plate is provided, corrosion occurs on the center flat plate 11, i.e., the portion where the main plate 15 is configured as a single layer, and leakage occurs. However, in the case of the plate-type heat exchanger of the present invention having the reinforcing plate and the improved design that appropriately determines the corrosion potential difference between the main plate, the reinforcing plate, and the bracket plate, the corrosion inhibition effect is assuredly exhibited, as shown in the table above.

The present invention is not limited to the above embodiments, and the scope of application is diverse. Of course, various modifications and implementations made by any person skilled in the art to which the present invention pertains without departing from the subject matter of the present invention claimed in the claims.

INDUSTRIAL APPLICABILITY

According to the present invention, the corrosion performance of the plate-type heat exchanger is improved by the simple improvement structure, which has a great effect on improving the durability. There is also the effect of smooth compatibility with existing products because of the simple improvement structure.

What is claimed is:

1. A plate-type heat exchanger comprising:

a plurality of stacked main plates each comprising a center flat plate having a fluid flowing structure including a through hole formed in the center flat plate, and a lateral blade formed by bending an edge of the center flat plate in one direction; and a reinforcing plate interposed between a bracket plate fixed to an external device and at least one of the plurality of stacked main plates connected to the bracket plate, wherein the reinforcing plate and the bracket plate are at least partially in surface contact with each other, wherein the reinforcing plate is in surface contact with the entire center flat plate of one of the plurality of stacked main plates and is in surface contact with at least a part of the lateral blade, wherein when one or more of the lateral blades of the plurality of stacked main plates overlap one another to define a multilayer and the remaining lateral blades of the remaining plurality of stacked main plates, which do not overlap one another, define a single layer as a heat exchanger core formed by stacking the plurality of stacked main plates so that the plurality of stacked main plates overlaps one another, the reinforcing plate is in surface contact with the lateral blade in a region including a single-layer forming region of the lateral blade in which the single layer is formed, wherein the bracket plate comprises:

a fixing plate portion comprising a plate surface portion provided to be in surface contact with one surface of the heat exchanger core, and a peripheral portion bent from an edge of the plate surface portion and configured to surround a part of a periphery of the heat exchanger core; and a connection plate portion integrated with the fixing plate portion and bent in a direction different from that of the peripheral portion in a region except for a region in which the peripheral portion is formed, the connection plate portion being connected to the external device, and wherein the reinforcing plate is in surface contact with at least a part of the lateral blade in a region in which the connection plate portion is formed.

2. The plate-type heat exchanger of claim 1, wherein the reinforcing plate and at least one of the plurality of stacked main plates are at least partially in surface contact with each other.

3. The plate-type heat exchanger of claim 1, wherein in the plate-type heat exchanger, a flow path, through which a fluid flows, is formed between the plurality of stacked main plates, and wherein a distance from an outermost peripheral flow path closest to the bracket plate to the bracket plate is larger than a thickness of at least one of the plurality of stacked main plates.

4. The plate-type heat exchanger of claim 3, wherein in the plate-type heat exchanger, the distance from the outermost peripheral flow path to the bracket plate is equal to or larger than 2 times the thickness of at least one of the plurality of stacked main plates.

5. The plate-type heat exchanger of claim 1, wherein in the plate-type heat exchanger, a thickness of the reinforcing plate and a thickness of at least one of the plurality of stacked main plates are different from each other.

6. The plate-type heat exchanger of claim 5, wherein in the plate-type heat exchanger, the thickness of the reinforcing plate is larger than the thickness of at least one of the plurality of stacked main plates.

7. The plate-type heat exchanger of claim 1, wherein in the plate-type heat exchanger, the reinforcing plate is formed separately from the plurality of stacked main plates.

8. The plate-type heat exchanger of claim 1, wherein in the plate-type heat exchanger, the reinforcing plate is integrated with at least one of the plurality of stacked main plates.

9. The plate-type heat exchanger of claim 8, wherein in the plate-type heat exchanger, the reinforcing plate is formed by increasing a thickness of at least one of the plurality of stacked main plates.

10. The plate-type heat exchanger of claim 1, wherein the reinforcing plate is formed in a shape of at least one of the plurality of stacked main plates excluding the fluid flowing structure.

11. The plate-type heat exchanger of claim 10, wherein the reinforcing plate is formed to have a thickness greater than at least one of the plurality of stacked main plates.

12. The plate-type heat exchanger of claim 10, wherein the reinforcing plate is made of the same type of metallic material as at least one of the plurality of stacked main plates.

13. The plate-type heat exchanger of claim 1, wherein in the plate-type heat exchanger, corrosion potential of the plurality of stacked main plates is equal to or higher than corrosion potential of the reinforcing plate.

14. The plate-type heat exchanger of claim 13, wherein in the plate-type heat exchanger, the corrosion potential of the reinforcing plate is equal to or higher than corrosion potential of the bracket plate.

15. The plate-type heat exchanger of claim 1, wherein in the plate-type heat exchanger, the plurality of stacked main plates, the reinforcing plate, and the bracket plate are made of the same type of metallic material.

16. The plate-type heat exchanger of claim 1, wherein in the plate-type heat exchanger, the plurality of stacked main plates, the reinforcing plate, and the bracket plate are joined by brazing.

* * * * *